US008515101B2

(12) United States Patent
Shiba

(10) Patent No.: US 8,515,101 B2
(45) Date of Patent: Aug. 20, 2013

(54) BENDING VIBRATION TYPE SOUND TRANSMITTER

(75) Inventor: Hiroshi Shiba, Tokyo (JP)

(73) Assignee: NEC Corporation, Tokyo (JP)

( * ) Notice: Subject to any disclaimer, the term of this patent is extended or adjusted under 35 U.S.C. 154(b) by 1116 days.

(21) Appl. No.: 12/049,058

(22) Filed: Mar. 14, 2008

(65) Prior Publication Data

US 2008/0240472 A1 Oct. 2, 2008

(30) Foreign Application Priority Data

Mar. 27, 2007 (JP) ..... 2007-83123

(51) Int. Cl.
*H04R 17/10* (2006.01)

(52) U.S. Cl.
USPC ..... 381/152; 381/162; 381/186; 381/347; 381/348

(58) Field of Classification Search
USPC ..... 381/152, 190, 191, 71.1, 71.7; 310/321, 310/325
See application file for complete search history.

(56) References Cited

U.S. PATENT DOCUMENTS

| | | | | | |
|---|---|---|---|---|---|
| 4,706,230 | A * | 11/1987 | Inoue et al. | ..... | 367/174 |
| 4,922,470 | A * | 5/1990 | McMahon et al. | ..... | 367/163 |
| 5,184,332 | A * | 2/1993 | Butler | ..... | 367/162 |
| 5,804,906 | A * | 9/1998 | Tsutsumi | ..... | 310/322 |
| 2003/0118195 | A1 * | 6/2003 | Hama | ..... | 381/71.1 |

FOREIGN PATENT DOCUMENTS

| | | | |
|---|---|---|---|
| JP | 62-8798 | U | 1/1987 |
| JP | 2-87798 | A | 3/1990 |
| JP | 2-214399 | A | 8/1990 |
| JP | 03011898 | A | 1/1991 |
| JP | 3-98399 | A | 4/1991 |
| JP | 9-105778 | A | 4/1997 |
| JP | 9-155288 | A | 6/1997 |
| JP | 2001309491 | A | 11/2001 |
| JP | 2002135881 | A | 5/2002 |
| JP | 2002345082 | A | 11/2002 |
| JP | 3520837 | B2 | 2/2004 |
| JP | 3649151 | B2 | 2/2005 |
| JP | 3785587 | B | 6/2006 |

OTHER PUBLICATIONS

Japanese Office Action for JP2007-083123 issued Sep. 6, 2011.

* cited by examiner

*Primary Examiner* — Minh-Loan T Tran
*Assistant Examiner* — Fazli Erdem

(57) ABSTRACT

A bending vibration type sound transmitter includes a plurality of vibrating bodies that perform resonant vibration and two lids. The plurality of vibrating bodies is fastened between the two lids.

11 Claims, 11 Drawing Sheets

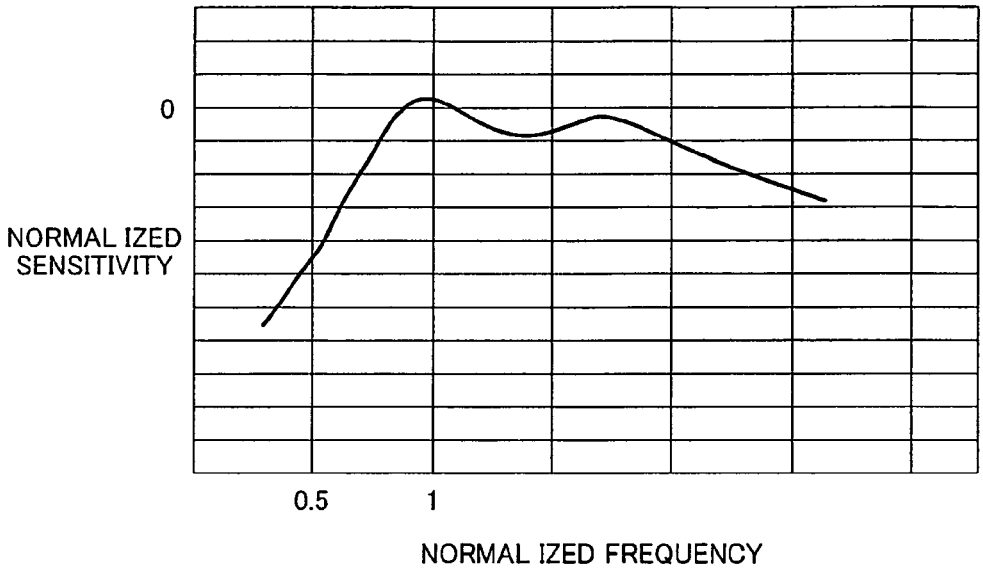
Fig.12
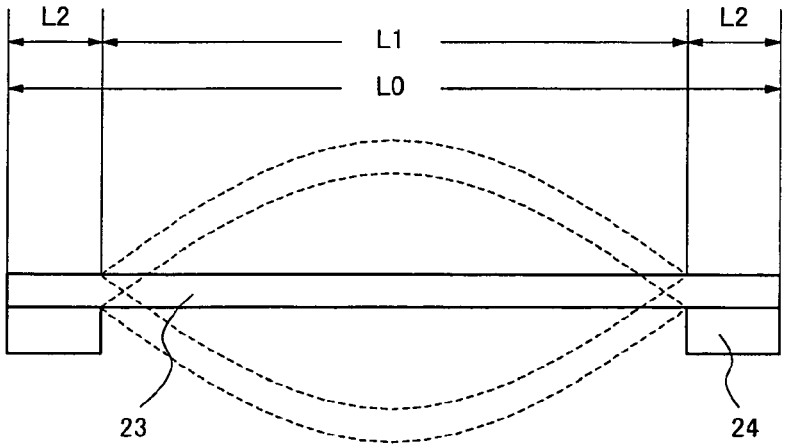
Fig.13 -- PRIOR ART --

-- PRIOR ART --

BENDING VIBRATION TYPE SOUND TRANSMITTER

INCORPORATION BY REFERENCE

This application is based upon and claims the benefit of priority from Japanese Patent Application No. 2007-083123, filed on Mar. 27, 2007, the disclosure of which is incorporated herein in its entirety by reference.

BACKGROUND OF THE INVENTION

1. Technical Field

The present invention relates to a sound transmitter for radiating a sound wave in water. In particular, the present invention relates to a bending vibration type sound transmitter for radiating a sound wave in water using bending vibration of a vibrating body.

2. Background Art

In an underwater survey such as an oceanographic survey, various sound transmitters using a sound wave as an observation tool are employed. A sound wave having a low frequency is often used because of low attenuation and good transmission characteristics in water. In the sound transmitters, in order to emit a sound wave with a low frequency efficiently, a vibrating body which generates the sound wave using a mechanical resonance as a radiation source thereof is often used.

An example of a vibration form of the vibrating body which generates the sound wave using the mechanical resonance is shown in FIG. 13. In FIG. 13, both ends of the vibrating body 23 are fixed on edge of fixing members 24. In such condition, as shown by dotted lines in FIG. 13, the vibrating body 23 resonates so that boundaries between the vibrating body 23 and the edge fixing members 24 become supporting points for forming nodes of vibration. When a full length of the vibrating body 23 is L0, and a length (free length) of a part of the vibrating body 23 which is not fixed on the edge of fixing members 24 is L1, resonant vibration of the vibrating body 23 generates a sound wave with a half-wave length of the free length L1. Therefore, in order to generate a sound wave with a low frequency, the free length L1 of the vibrating body 23 needs to be long.

The vibrating body 23 resonates so that boundaries between the vibrating body 23 and the edge fixing members 24 become supporting points for nodes of vibration. In order to maintain the stable resonant vibration, a fixed length L2 needs to be long to some extent so that the nodes of the resonant vibration do not move. When the free length L1 of the vibrating body 23 is long, it is desirable also to make the fixed length L2 long.

On the other hand, the sound transmitter is usually required to be small and lightweight. But, when the free length L1 and the fixed length L2 of the vibrating body 23 are made long to lower a resonance frequency, the full length L0 of the vibrating body 23 becomes long and a weight thereof increases. Therefore, the sound transmitter becomes large and heavy.

Here, as the sound transmitter using a sound wave with a low frequency, a bending vibration type sound transmitter is widely used. The bending vibration type sound transmitter includes a vibrating body in which a driving transducer and a vibrating plate for sound wave emission are arranged. The driving transducer is a piezoelectric transducer which vibrates by applying a voltage signal. The vibrating plate for sound wave emission includes a metallic thin plate or the like. The driving transducer makes bending vibration of the vibrating plate to generate a sound wave. Moreover, the metallic thin plate has low elasticity and can lower the resonance frequency of the vibrating body. Therefore, a small sound transmitter for generating a sound wave with a low frequency can be realized.

A bending vibration type sound transmitter is disclosed in Japanese Patent Application Laid-Open No. 1991-11898 (document 1). In the bending vibration type sound transmitter, a cylindrical metal body having a plurality of slits in an axial direction thereof forms a plurality of vibrating plates (vibrating plates for sound wave emission). The piezoelectric transducers (driving transducers) are used on inside or outside surfaces of the vibrating plates. In the bending vibration type sound transmitter, the piezoelectric transducers are vibrated by application of a voltage signal. The vibrating plates perform bending vibration according to vibration of the piezoelectric transducers and generate a sound wave.

Other bending vibration type sound transmitter is disclosed in Japanese Patent Gazette No. 3520837 (document 2). In the bending vibration type sound transmitter of the document 2, a cylindrical vibrator (driving transducer) is formed of laminated and combined vibrator pieces. The cylindrical vibrator includes a plurality of side face vibrating plates (first vibrating plates for sound wave emission) and end face vibrating plates (second vibrating plates for sound wave emission). Here, a plurality of slits formed in an axial direction of a cylindrical metal plate form the side face vibrating plates therein. In the bending vibration type sound transmitter, the cylindrical vibrators vibrate according to application of a voltage signal. The side face vibrating plates and the end face vibrating plates perform bending vibration to generate a sound wave. Since two kinds of vibrating plates, the side diaphragms and the end face vibrating plates, are used as vibrating plates for sound wave emission, a frequency of a sound wave is lowered and a frequency band is broadened.

Moreover, other bending vibration type sound transmitter is disclosed in Japanese Patent Gazette No. 3649151 (document 3). In the bending vibration type sound transmitter of the document 3, a plurality of vibrating plates (vibrating plates for sound wave emission) are divided by a plurality of slits formed in an axial direction of a cylindrical elastic body. Each end of the upper part and the lower part of the plurality of vibrating plates is fixed on each of two vibrating bodies (driving transducers). The two vibrating bodies vibrate to make bending vibration of a plurality of vibrating plates and generate a sound wave.

Here, in the bending vibration type sound transmitters disclosed in the documents 1-3, the plurality of vibrating plates are formed by the plurality of slits in an axial direction of the cylindrical body. A fragmentary perspective view of an example of a side piece of the cylindrical body is shown in FIG. 14. In FIG. 14, a part where a slit 25 of the cylindrical body is formed performs bending vibration by using a boundary of a part where a slit 25 of the cylindrical body is not formed as a supporting point on which a node of bending vibration is formed. Therefore, in order to generate a sound wave of a low frequency, the length L1 of the part where the slit 25 is formed should be made long. On the other hand, in order to maintain the bending vibration of the cylindrical body in the stable state as mentioned above, the length L2 of the part where the slit 25 of the cylindrical body is not formed needs to be made long to some extent so that the supporting point of bending vibration does not move.

SUMMARY

An exemplary object of the present invention is to provide a bending vibration type sound transmitter with a small size and a light weight which is capable of emitting a sound wave of a low frequency using resonant vibration of a vibrating body.

A bending vibration type sound transmitter according to an exemplary aspect of the invention includes a plurality of vibrating bodies that perform resonant vibration and two lids. The plurality of vibrating bodies is fastened between the two lids.

BRIEF DESCRIPTION OF THE DRAWINGS

Exemplary features and advantages of the present invention will become apparent from the following detailed description when taken with the accompanying drawings in which:

FIG. 12 is a frequency characteristic diagram showing a relation between a normalized sensitivity (vertical axis) and normalized frequency (horizontal axis) obtained by the bending vibration type sound transmitter;

FIG. 13 is a schematic diagram showing a configuration of a bending vibration type sound transmitter and a vibration form of a related art.

EXEMPLARY EMBODIMENT

Exemplary embodiments of the present invention will now be described in detail in accordance with the accompanying drawings.

First Exemplary Embodiment

Figure 1:
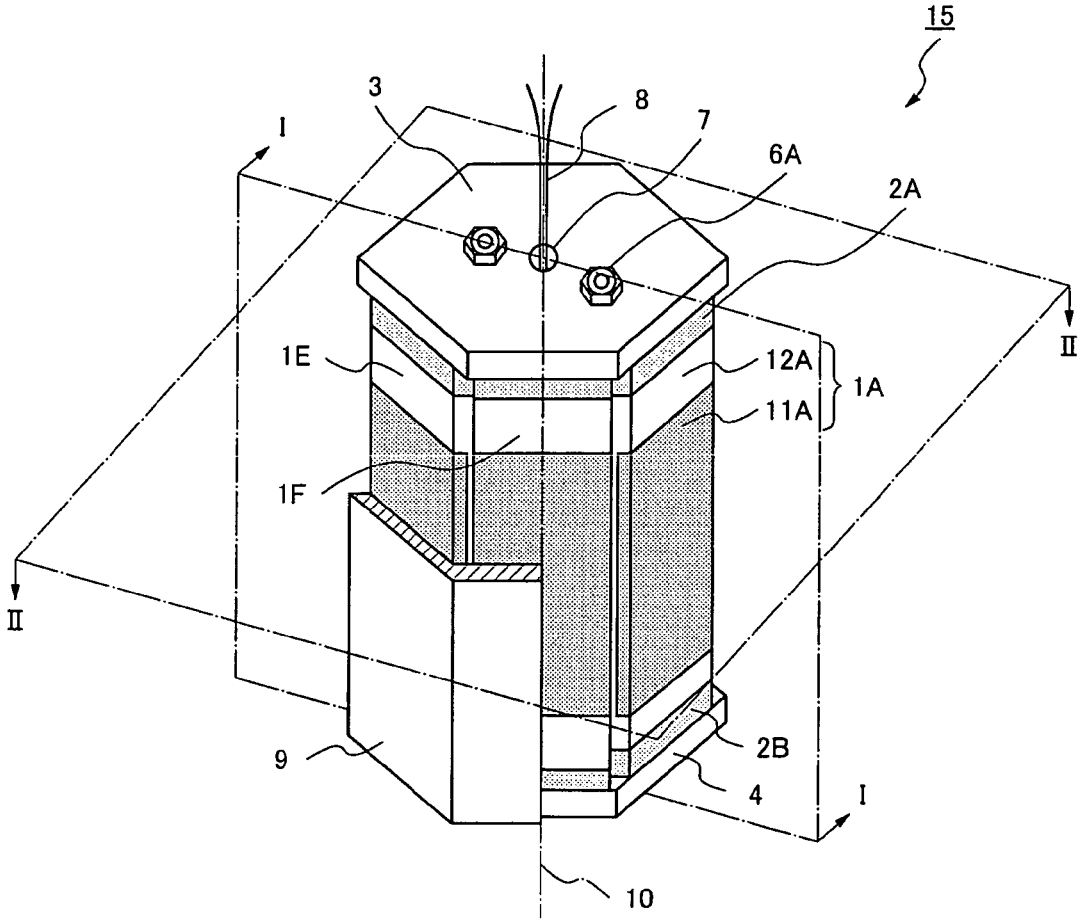
FIG. 1 is a perspective view including a cutout configuration in a part showing a schematic configuration of a bending vibration type sound transmitter according to a first exemplary embodiment of the present invention.

FIG. 1 is a perspective view of a bending vibration type sound transmitter 15 without a part of an insulating sheath 9 thereof of a first exemplary embodiment of the present invention. The bending vibration type sound transmitter 15 includes six tabular vibrators 1A-1F, upper buffering materials 2A, lower buffering materials 2B, an upper lid 3, a lower lid 4 and a plurality of signal lines 8. The tabular vibrators 1A-1F are connected with signal lines 8 inside the bending vibration type sound transmitter 15, and the tabular vibrators 1A-1F resonate by electric signals applied from the signal lines 8 to generate sound waves.

In FIG. 1, each of the six tabular vibrators 1A-1F is formed into a rectangle. A long side of each of the tabular vibrators comes close to each other to form a hexagonal column. Both ends of the upper part and the lower part of the hexagonal column formed by the tabular vibrators 1A-1F is fixed by pressing with the upper lid 3 and the lower lid 4 via the upper buffering materials 2A and the lower buffering materials 2B.

Figure 2:
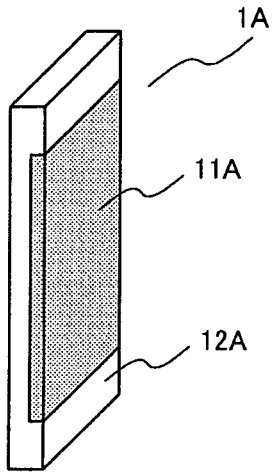
FIG. 2 is a perspective view showing a schematic configuration of a tabular vibrator used for the bending vibration type sound transmitter.

Next, each component of the bending vibration type sound transmitter 15 will be described. FIG. 2 shows a perspective view of an example of the tabular vibrator 1A used for the bending vibration type sound transmitter 15 according to the first exemplary embodiment. The tabular vibrator 1A includes a tabular piezoelectric element 11A as a driving transducer and a vibrating plate 12A for a vibrating plate for sound wave emission. The vibrating plate 12A includes a concave portion on one surface thereof. The tabular piezoelectric element 11A is embedded inside the concave portion. The piezoelectric element 11A is adhered to the concave portion of the vibrating plate 12A by an adhesive material. Other tabular vibrators 1B-1F are also formed in the same manner as the tabular vibrator 1A.

Figure 3:
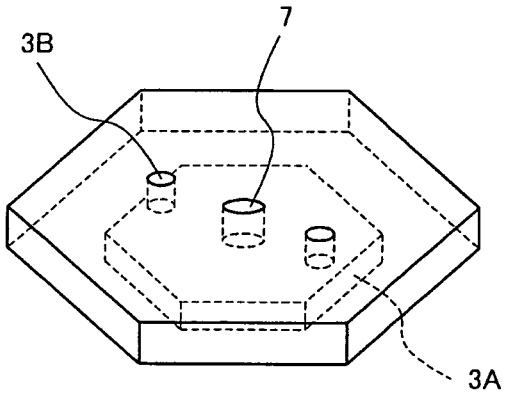
FIG. 3 is a perspective view showing a schematic configuration of an upper lid used for the bending vibration type sound transmitter.

FIG. 3 is a perspective view of an example of the upper lid 3 of the bending vibration type sound transmitter 15. The upper lid 3 is formed into hexagonal shape so as to correspond to the hexagonal column shape formed by the tabular vibrators 1A-1F. The upper lid 3 includes a protruding portion 3A on an underside thereof for fitting in the hexagonal column in order to firmly hold the hexagonal column. The upper lid 3 further includes a hole 7 for pulling out the signal lines 8 and a pair of bolt holes 3B for inserting "a stepped bolt 5" (described later) in the approximately middle part of the upper lid 3.

Figure 4:
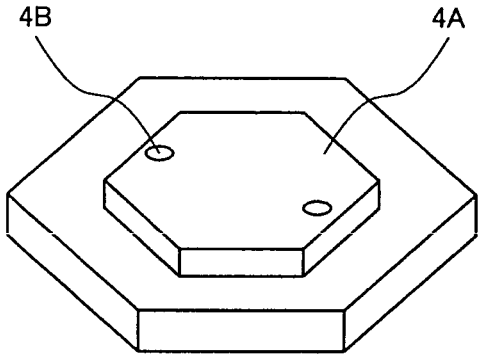
FIG. 4 is a perspective view showing a schematic configuration of a lower lid used for the bending vibration type sound transmitter.

FIG. 4 is a perspective view of an example of the lower lid 4 of the bending vibration type sound transmitter. A outline of the lower lid 4 is formed into hexagonal shape so as to correspond to the upper lid 3. The lower lid 4 includes a protruding portion 4A and bolt holes 4B corresponding to the protruding portion 3A and the bolt holes 3B formed in the upper lid 3, respectively.

Figure 5A:
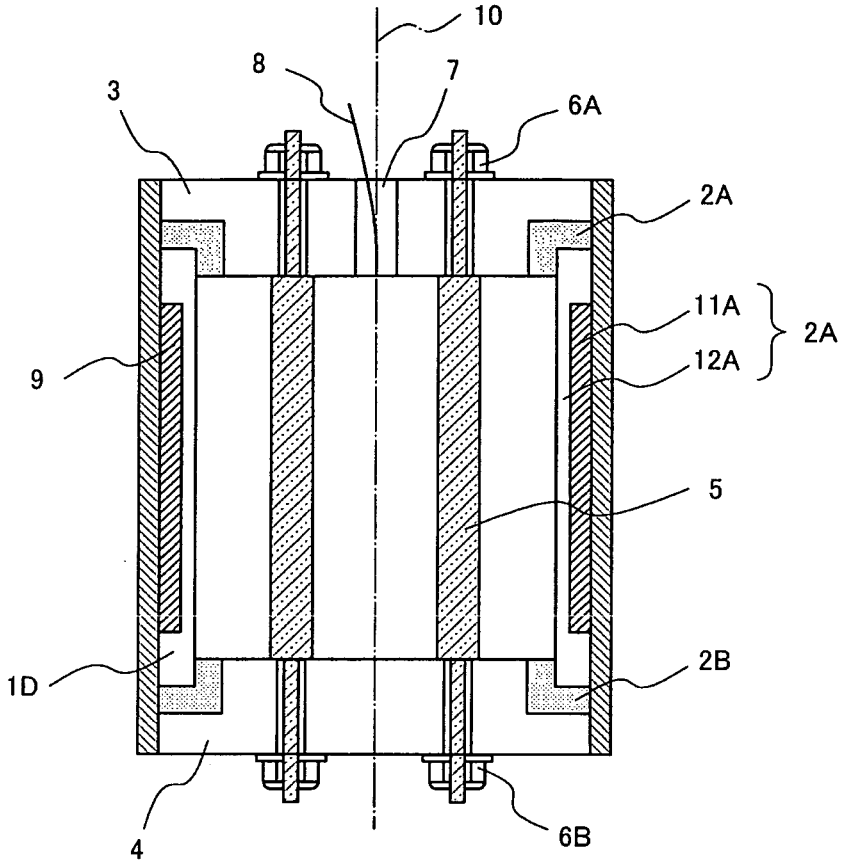
FIG. 5A is a cross sectional view across I-I plane in FIG. 1.
Figure 5B:
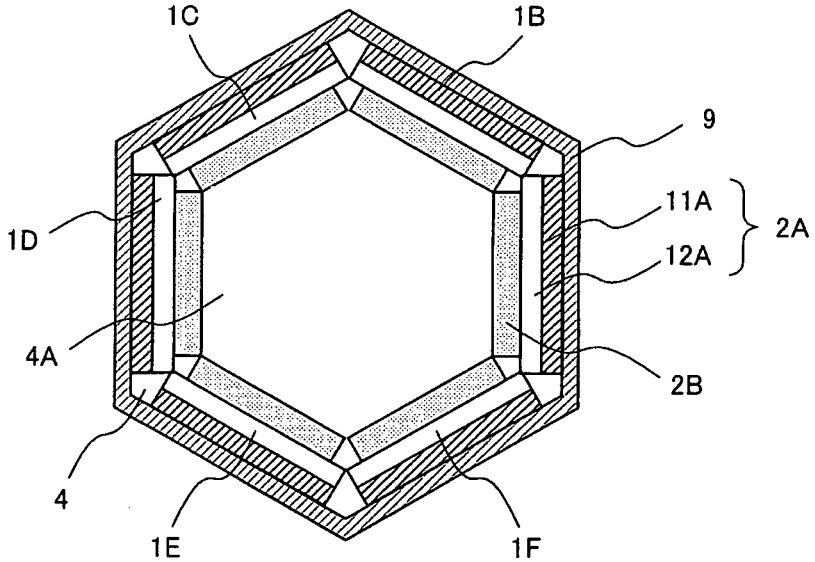
FIG. 5B is a cross sectional view across II-II plane in FIG. 1.

Next, a structure of the bending vibration type sound transmitter according to the first exemplary embodiment will be described using FIGS. 5A and 5B. FIG. 5A is a cross sectional view across I-I plane in FIG. 1 and FIG. 5B is a cross sectional view across II-II plane in FIG. 1. In FIGS. 5A and 5B, the hexagonal column forming by the tabular vibrators 1A-1F is arranged between the upper lid 3 and the lower lid 4 via the upper buffering materials 2A and the lower buffering materials 2B. Both ends of the stepped bolts 5 which are arranged in the bolt holes 3*b*, the bolt holes 4*b*, and the hexagonal column are tightened with nuts 6A and 6B. Then, the upper lid 3 and the lower lid 4 are fastened by the nuts 6A and 6B. Accordingly, the upper lid 3 and the lower lid 4 fasten the hexagonal column, that is, the six tabular vibrators 1A-1F.

Here, "the stepped bolt 5" is used in order to fix the upper lid 3 and the lower lid 4. "The stepped bolt 5" has a step part where the diameter thereof changes. The diameter of the stepped bolt 5 from the step part to the edge side is smaller than that of center side. Because the upper lid 3 and the lower lid 4 are stopped at the step part of "the stepped bolt 5", each of tabular vibrators 1A-1F is not damaged.

In order to fit the protruding portion 3A of the upper lid 3, the upper buffering material 2A has an L-shaped part. In order to fit the protruding portion 4A of the lower lid 4, the lower buffering material 2B also has the L-shaped part. In the first exemplary embodiment, the upper buffering materials 2A and the lower buffering materials 2B are made of an onion skin paper. Being strongly pressured, the buffering materials 2A and 2B are required for high intensity and small elasticity. The onion skin paper having such characteristics is suitable for the buffering material. The buffering materials 2A and 2B are not limited to the onion skin paper. Various materials can be selected so that a maximum effect may be demonstrated corresponding to a sound wave of a low frequency used for the bending vibration type sound transmitter 15.

Moreover, an insulating sheath 9 covers an outer surface of the hexagonal column. The insulating sheath 9 provides water resistance to the hexagonal column, that is, the bending vibration type sound transmitter 15.

The signal lines 8 arranged in the hexagonal column are connected electrically to the piezoelectric elements 11A-11F of the tabular vibrators 1A-1F which form the hexagonal column. The piezoelectric elements 11A-11F receive electric signals through the signal lines 8 connected to perform bending vibration as resonant vibration. According to the resonant vibration of the piezoelectric elements 11A-11F, the vibrating plates 12A-12*f* of the tabular vibrators 1A-1F vibrate in a bending manner to emit a sound wave in a radial direction of the hexagonal column.

Here, because the six tabular vibrators 1A-1F are fastened between the upper lid 3 and the lower lid 4 via the buffering materials 2A and 2B, the six tabular vibrators 1A-1F can perform stable resonant vibration of which nodes are located at junctions between the tabular vibrators 1A-1F and the buffering materials 2A and 2B.

Figure 6:
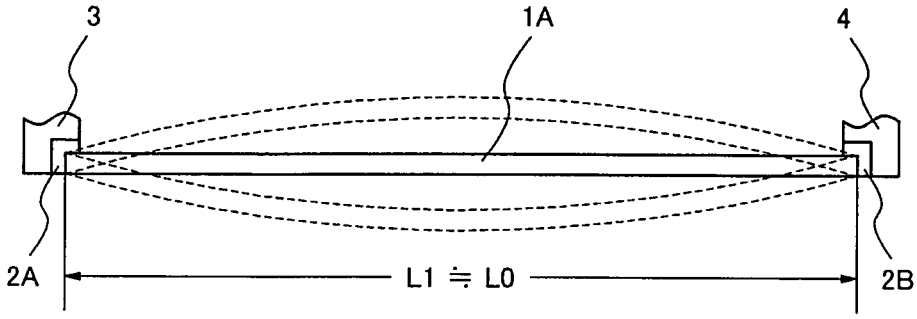
FIG. 6 is a schematic diagram showing a configuration of the bending vibration type sound transmitter and a vibration form thereof.

FIG. 6 is a schematic diagram showing an example of the vibration mode of the tabular vibrator 1A. In FIG. 6, the tabular vibrator 1A is sandwiched with the upper lid 3 and the lower lid 4 via the buffering materials 2A and 2B and fastened and pressed from both ends thereof. If vibrating plates formed by providing slits in a cylindrical body is used, in order to maintain stable resonant vibration in a part (L1) where the slit is formed, a part where the slit is not formed needed to be reserved to some extent as a fixed end. In contrast, in the bending vibration type sound transmitter 15 according to the first exemplary embodiment, end portions of the tabular vibrators 1A-1F do not need to be secured as the fixed end. That is, in FIG. 6, a free length L1 of the tabular vibrator 1A becomes approximately equal to a full length L0 of the tabular vibrator 1A.

A structure that both ends of the tabular vibrator 1A are fastened with the upper lid 3 and the lower lid 4 can shorten a full length Lo of the tabular vibrator more than a structure that end parts of the tabular vibrator are employed as fixed ends for resonant vibration. Therefore, in a bending vibration type sound transmitter for emitting a sound wave with an predetermined frequency, the former structure as shown in the first exemplary embodiment of the present invention can provide a small size and light-weight bending vibration type sound transmitter.

Figure 7:
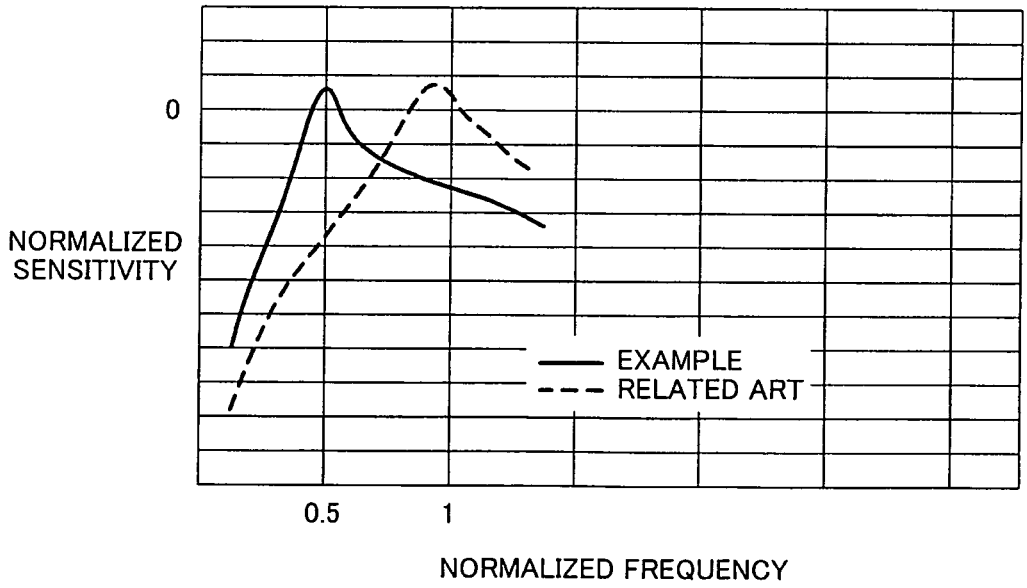
FIG. 7 is a frequency characteristic diagram showing a relation between a normalized sensitivity (vertical axis) and normalized frequency (horizontal axis) obtained by the bending vibration type sound transmitter.

FIG. 7 shows a result of simulation in which a frequency characteristic of the bending vibration type sound transmitter 15 according to the first exemplary embodiment of the present invention and a characteristic of the bending vibration type sound transmitter according to a related art are compared. In FIG. 7, a horizontal axis is a normalized frequency and a frequency of an emitted sound wave becomes low in a rightward direction of the axis. A vertical axis is a normalized sensibility and a peak thereof is located in a position corresponding to a center frequency of the emitted sound wave.

In FIG. 7, a solid line shows an acoustic characteristic of a plurality of vibrating plates fastened by two lids, and a dotted line shows an acoustic characteristic of a metal plate having a plurality of slits and fixing parts without the slits fixed on two lids. That is, the solid line shows the frequency characteristic of the bending vibration type sound transmitter 15 according to the first exemplary embodiment, and the dotted line shows the frequency characteristic of the bending vibration type sound transmitter according to the related art corresponding to the document 1. Both of two models shown in FIG. 7 correspond to the bending vibration type sound transmitters of which lengths are the same, and which include a vibrating plate and two lids. In FIG. 7, the center frequency in the solid line is lower than that in the dotted line. This is because the free length of the vibrating plate fastened with two lids is longer than that of the vibrating plate in which both ends thereof are used as fixed ends. That is, as for a bending vibration type sound transmitter of a predetermined size, a bending vibration type sound transmitter in which a plurality of vibrating plates is fastened with two lids can emit a sound wave with a lower frequency.

Next, a method of manufacturing the bending vibration type sound transmitter 15 according to the first exemplary embodiment will be described. First, six tabular vibrators 1A-1F are prepared, top ends of the tabular vibrators 1A-1F stick to the upper buffering material 2A having a L-shaped part, and bottom ends of the tabular vibrators 1A-1F stick to the lower buffering material 2B having a L-shaped part.

Next, the hexagonal column is formed by arranging the tabular vibrators 1A-1F so that mutual long sides thereof may be approached. A cross section of the hexagonal column is slightly larger than a contour of the lower lid 4. Next, the signal lines 8 are electrically connected to electrodes of the tabular vibrators 1A-1F by solder. On the other hand, the stepped bolts 5 are inserted into the bolt holes 3B of the upper lid 3 and the bolt holes 4B of the lower lid 4. Both ends of the stepped bolts 5 are set loosely by the nuts 6A and 6B.

Then, the hexagonal column including the upper buffering material 2A, the lower buffering material 2B and the tabular vibrators 1A-1F in which the signal lines 8 are installed is put in from the lower lid 4, and is arranged around the protruding portion 4A of the lower lid 4. At that time, the lower buffering material 2B is arranged between the tabular vibrators 1A-1F and the lower lid 4.

Next, the signal lines 8 are pulled out from the hole 7 of the upper lid 3. After that, the tabular vibrators 1A-1F of the hexagonal column are arranged around the protruding portion 3A of the upper lid 3. At that time, the upper buffering material 2A is arranged between the tabular vibrators 1A-1F and the upper lid 3. The nuts 6A and 6B are screwed in from both ends of the stepped bolt 5, and the upper lid 3 and the lower lid 4 are fixed completely. Moreover, in order to form water resistance, sides of the tabular vibrators 1A-1F, the upper lid 3 and the lower lid 4 of the hexagonal column are covered with the insulating sheath 9 formed by molding method.

As a result, the bending vibration type sound transmitter 15 according to the first exemplary embodiment having a structure that the tabular vibrators 1A-1F of the hexagonal column are fastened by the upper lid 3 and the lower lid 4 via the upper buffering material 2A and the lower buffering material 2B is obtained. Because the tabular vibrators 1A-1F are fastened between the upper lid 3 and the lower lid 4 via the buffering materials 2A and 2B, the bending vibration type sound transmitter 15 according to the first exemplary embodiment does not need to use a part of the tabular vibrators 1A-1F for fixing. When a bending vibration type sound transmitter for emitting a sound wave with a predetermined frequency is formed, the bending vibration type sound transmitter 15 according to the first exemplary embodiment of the present invention can decrease a full length of the tabular vibrator, compared with the bending vibration type sound transmitter which uses a part of the tabular vibrator for fixing. Therefore, according to the first exemplary embodiment of the present invention, a small size and light-weight bending vibration type sound transmitter can be provided.

Further, the bending vibration type sound transmitter of the first exemplary embodiment of the present invention is not limited to configuration above mentioned. For example, in the above-mentioned bending vibration type sound transmitter 15, although six tabular vibrators 1A-1F are used, three or more optional numbers of the tabular vibrators are available. A forming method of the insulating sheath 9 is not limited to the molding method, and a case of elastic material having water resistance such as rubber molded in advance can be used. Moreover, when water resistance can be maintained, it is not necessarily required to cover with the insulating sheath 9. If stable resonant vibration of the tabular vibrators 1A-1F can be maintained by using suitable materials of the tabular vibrators 1A-1F, the upper lid 3 and the lower lid 4 and suitable shapes thereof, the upper buffering material 2A and the lower buffering material 2B may be omitted.

Figure 8:
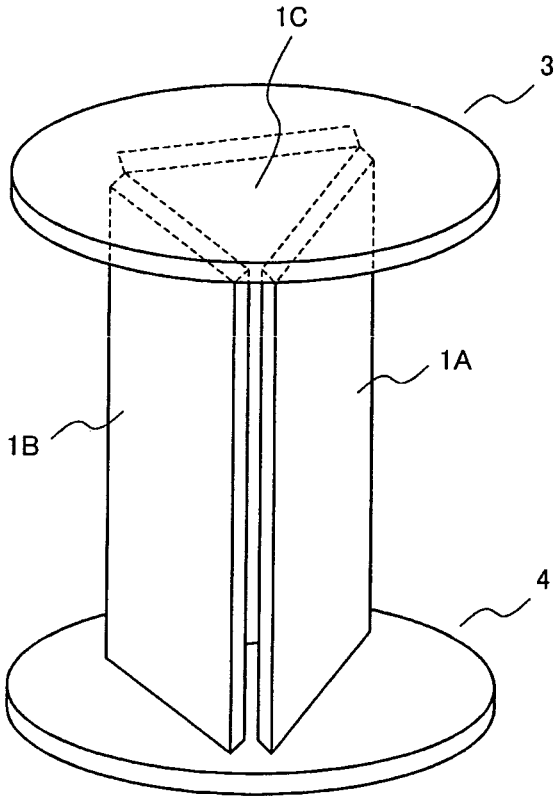
FIG. 8 is a fragmentary perspective view of a different bending vibration type sound transmitter according to the first exemplary embodiment of the present invention.

FIG. 8 is a perspective view of an example of a bending vibration type sound transmitter having a minimum number of components. In FIG. 8, the bending vibration type sound transmitter 15 includes a triangle column including three vibrating plates 1A-1C, an upper lid 3 and a lower lid 4 for fastening the triangle column from the top and the bottom thereof, respectively. Because the vibrating plates 1A-1C are fastened between the upper lid 3 and the lower lid 4, resonant vibration in which full lengths of the vibrating plates 1A-1C is a free length can be performed. Then, the bending vibration type sound transmitter 15 with small size and light weight for emitting a sound wave with a low frequency can be provided.

Second Exemplary Embodiment

Figure 9:
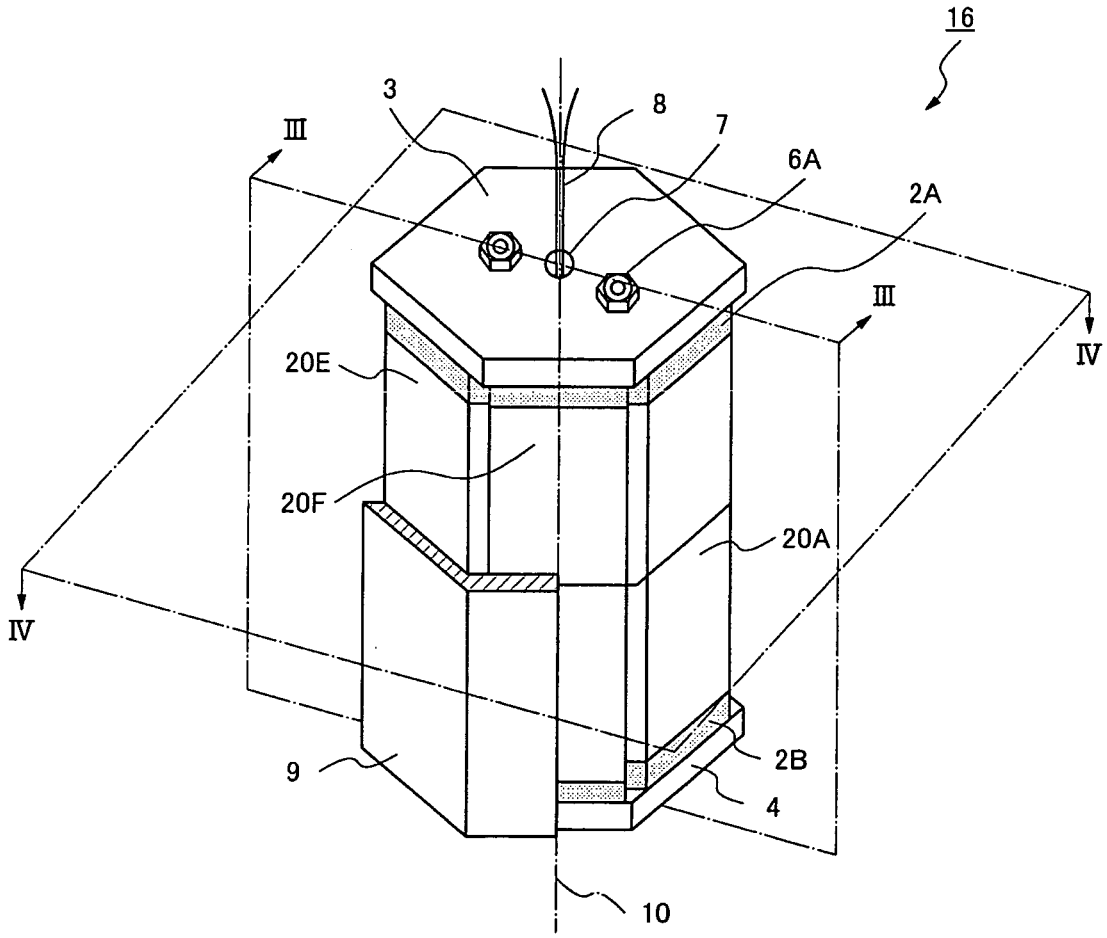
FIG. 9 is a perspective view including a cutout configuration in a part showing a schematic configuration of a bending vibration type sound transmitter according to a second exemplary embodiment of the present invention.

A second exemplary embodiment of the present invention will be described. FIG. 9 is a perspective view of a bending vibration type sound transmitter 16 without a part of an insulating sheath 9 according to the second exemplary embodiment. The bending vibration type sound transmitter 16 according to the second exemplary embodiment includes a box-like compound vibrator instead of a tabular vibrator. In FIG. 9, the box-like compound vibrators 20A-20F are used for the bending vibration type sound transmitter 16 instead of the tabular vibrators 1A-1F in the first exemplary embodiment. The configuration of the bending vibration type sound transmitter 16 according to the second exemplary embodiment is equal to a configuration of the bending vibration type sound transmitter 15 according to the first exemplary embodiment, except for the box-like compound vibrator.

Figure 10:
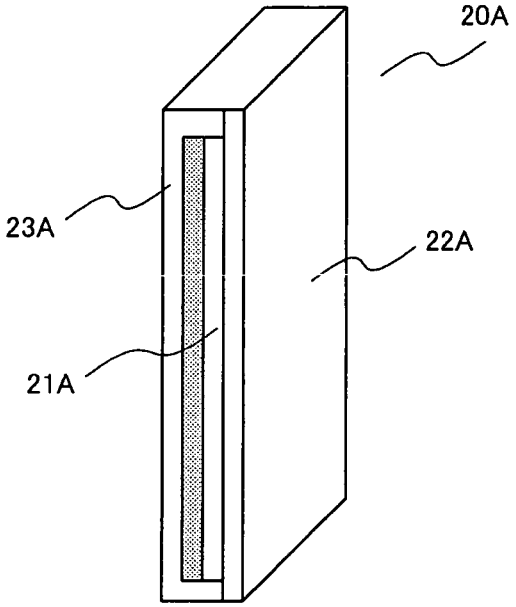
FIG. 10 is a perspective view showing a schematic configuration of a box-like compound vibrator used for the bending vibration type sound transmitter.

FIG. 10 is a perspective view showing a schematic configuration of the box-like compound vibrator used for the bending vibration type sound transmitter 16 according to the second exemplary embodiment. The box-like compound vibrator 20A includes the tabular piezoelectric element 21A as a driving transducer, the first tabular vibrating plate 22A and the second vibrating plate 23A having the concave portion for vibrating plates for sound wave emission sound wave emission. In FIG. 10, one face of the piezoelectric element 21A is fixed on the first vibrating plate 22A. The second vibrating plate 23A is fixed to the first vibrating plate 22A so that the piezoelectric element 21A may be arranged inside the concave portion of the second vibrating plate 23A. Here, a space is formed between the piezoelectric element 21A and the second vibrating plate 23A. The piezoelectric element 21A is fixed on the first vibrating plate 22A by an adhesive. Other box-like compound vibrators 20B-20F are formed in the same manner.

Figure 11A:
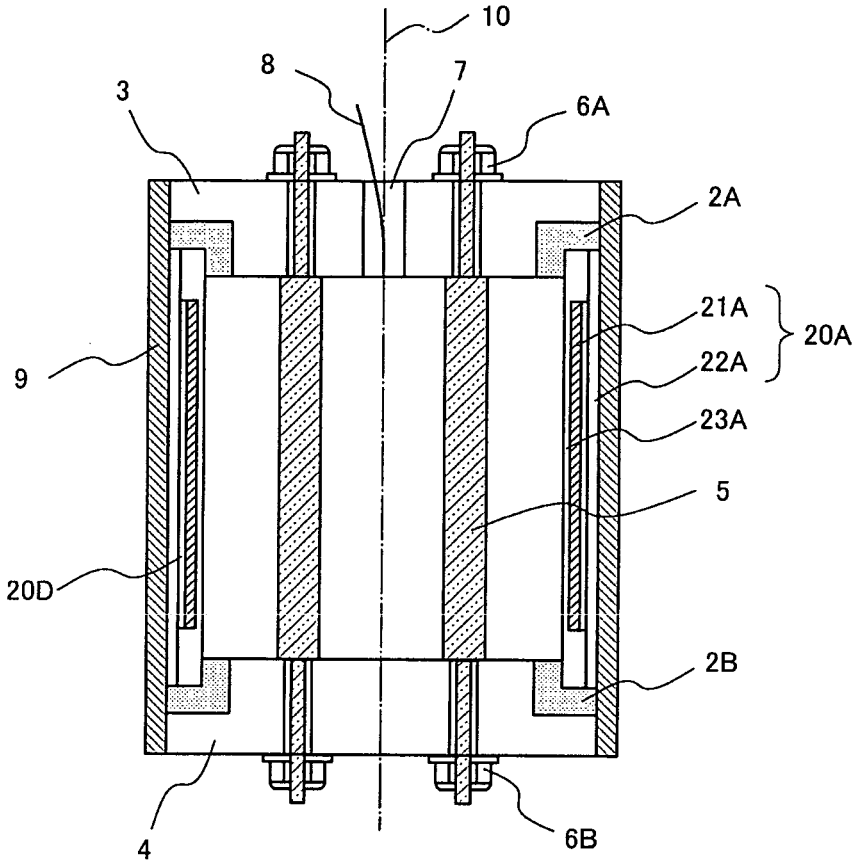
FIG. 11A is a cross sectional view across III-III plane in FIG. 9.
Figure 11B:
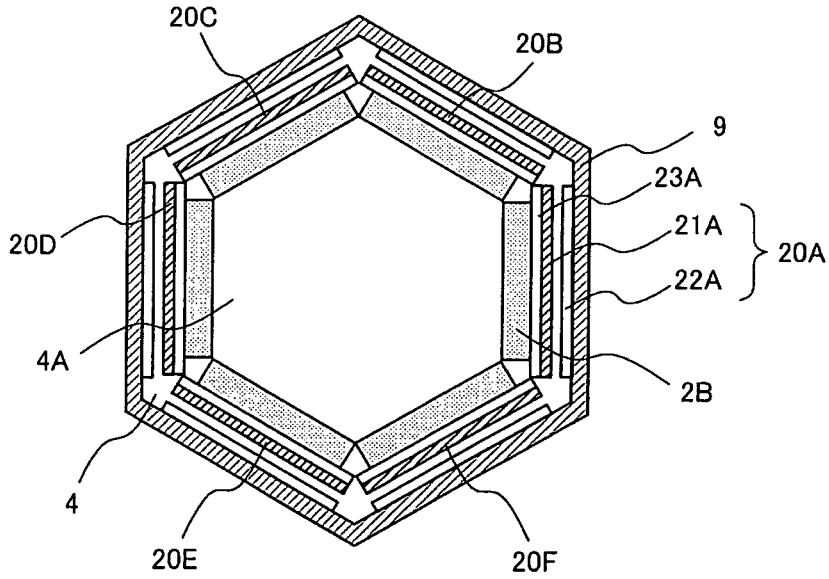
FIG. 11B is a cross sectional view across IV-IV plane in FIG. 9.
Figure 14:
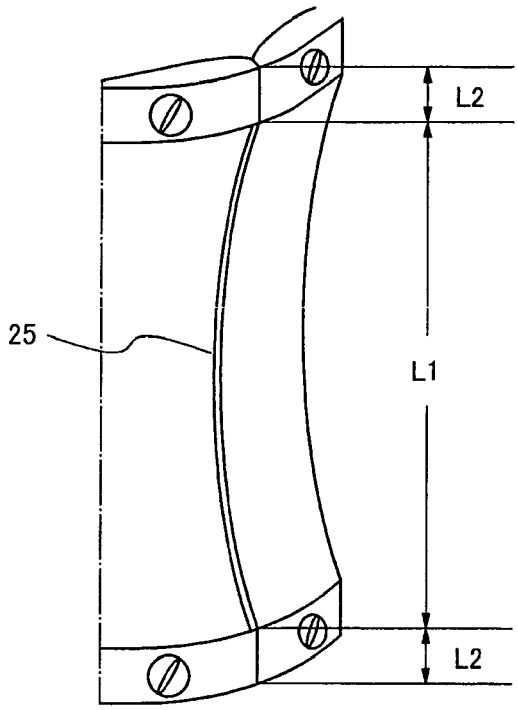
FIG. 14 is a perspective view showing a schematic configuration of a body of a bending vibration type sound transmitter of a related art.

FIG. 11A is a cross sectional view across III-III plane in FIG. 9, and FIG. 11B is a cross sectional view across IV-IV plane in FIG. 9. In FIGS. 11A and 11B, a structure of the bending vibration type sound transmitter 16 is equal to that of the bending vibration type sound transmitter 15 according to the first embodiment, except for the box-like compound vibrators 20A-20F. Therefore, the number identical to each part corresponding to FIGS. 5A and 5B is attached to FIGS. 11A and 11B, and a detailed description of FIGS. 11A and 11B is omitted. As shown in FIGS. 11A and 11B, in the second exemplary embodiment, the six box-like compound vibrators 20A-20F are fastened between the upper lid 3 and the lower lid 4 via the buffering materials 2A and 2B. Therefore, parts of the first vibrating plates 22A-22F and the second vibrating plates 23A-23F do not need to secure as fixed portions.

When the bending vibration type sound transmitter for emitting a sound wave with a predetermined frequency is formed, the structure in the second embodiment that the box-like compound vibrators 20A-20F are fastened between the upper lid 3 and the lower lid 4 can decrease full lengths of the first vibrating plates 22A-22F and the second vibrating plates 23A-23F, compared with the structure in which a part of the tabular vibrator is used for fixing. Therefore, the bending vibration type sound transmitter 16 having a small size and a light weight for emitting a sound wave with a low frequency can be provided.

Moreover, the first vibrating plate 22A and the second vibrating 23A having the concave portion are used for the vibrating plate for sound wave emission in the box-like compound vibrator 20A of the bending vibration type sound transmitter 16 according to the second exemplary embodiment. The first vibrating plate 22A and the second vibrating plate 23A act as a vibrating plate for sound wave emission. That is, a sound wave with a resonant frequency fr1 is emitted from the first vibrating plate 22A, and a sound wave with a resonant frequency fr2 is emitted from the second vibrating plate 23A. The bending vibration type sound transmitter 16 including box-like compound vibrators 20A-20F each having resonant frequencies fr1 and fr2 shows a double hump response having two peaks in a frequency characteristic. Therefore, the bending vibration type sound transmitter 16 has a broadband frequency characteristic.

FIG. 12 shows the frequency characteristic of the bending vibration type sound transmitter 16 according to the second exemplary embodiment. As shown in FIG. 12, a center frequency appears at two positions of around 1.0 and 1.7 of a normalized frequency. Further, because the bending vibration type sound transmitter 16 according to the second exemplary embodiment can be produced by a method mostly similar to the bending vibration type sound transmitter 15 according to the first exemplary embodiment, the description for the method will be omitted.

In the bending vibration type sound transmitter 16 according to the second exemplary embodiment, the box-like compound vibrators 20A-20F are fastened between the upper lid 3 and the lower lid 4 via the upper buffering material 2A and the lower buffering material 2B as mentioned above. When a bending vibration type sound transmitter for emitting a sound wave of a predetermined frequency is formed, the structure in the bending vibration type sound transmitter 16 according to the second exemplary embodiment can decrease full lengths of the first vibrating plates 22A-22F and the second vibrating plates 23A-23F, compared with the structure that a part of the box-like compound vibrator is used for fixing. Therefore, the bending vibration type sound transmitter 16 having a small size and a light weight for emitting a sound wave with a low frequency can be provided.

Moreover, in the bending vibration type sound transmitter 16, the box-like compound vibrators 20A-20F formed by the first vibrating plates 22A-22F and the second vibrating plates 23A-23F are employed as vibrating plates for sound wave emission. The sound wave with a resonant frequency fr1 is emitted from the first vibrating plates 22A-22F, and the sound wave with resonant frequency fr2 is emitted from the second vibrating plates 23A-23F. Therefore, the bending vibration type sound transmitter 16 having the broadband frequency characteristic is provided.

As a bending vibration type sound transmitter for emitting a sound wave with a low frequency, a bending vibration type sound transmitter in which a plurality of slit portions arranged in an axial direction of a cylindrical body perform resonant vibration is disclosed in the documents 1-3 described in the background art.

The related art causes a following problem. That is, when a length L1 of the slit 25 is elongated in order to generate a sound wave with a lower resonant frequency, it is also necessary to elongate a length L2 of a part where the slit 25 of the cylindrical body is not formed to maintain stable resonant vibration. Therefore, if the bending vibration type sound transmitter disclosed in the documents 1-3 is used for generating a sound wave with a lower resonant frequency by making the lengths L1 and L2 long, the size of the bending vibration type sound transmitter is large and its weight is heavy.

In contrast, in the bending vibration type sound transmitter according to the exemplary embodiments of the present invention, a column formed by a plurality of tabular vibrators is fastened between an upper lid and a lower lid via buffering materials. A fixed portion for steadily maintaining resonant vibration is unnecessary in vibrating plates forming the column in the bending vibration type sound transmitter according to the present invention. Therefore, the present invention can provide a small and lightweight bending vibration type sound transmitter for emitting a sound wave with a low frequency.

A specific configuration of the invention is not limited to the exemplary embodiments above. Even if there is some change or the like in a design in a range which does not deviate from an essential point of the present invention, such changes are included in the present invention. The bending vibration type sound transmitter of the present invention is widely applicable for fields such as a small sound source buoy dropped and used underwater, and a low frequency sound source hung from a vessel and used in water.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims. Further, it is the inventors intention to retain all equivalents of the claimed invention even if the claims are amended during prosecution.

What is claimed is:

1. A bending vibration type sound transmitter, comprising:

a plurality of rectangular-shaped vibrating bodies performing resonant vibration, said plurality of vibrating bodies having a plurality of short sides and a plurality of long sides; and two lids, wherein the short sides of said plurality of vibrating bodies are fastened between said two lids, wherein said plurality of vibrating bodies contact one another on the long sides thereof to form a column, wherein the two lids each comprise a convex portion, each convex portion forming a step portion having an L-shaped cross-sectional profile, the short sides of the plurality of vibrating bodies fastened between the step portions formed by the convex portions of the two lids.

2. The bending vibration type sound transmitter according to claim 1, wherein each of said vibrating bodies includes a driving transducer vibrating by applying an electric signal and at least one resonating vibrator driven by said driving transducer.

3. The bending vibration type sound transmitter according to claim 1, wherein said plurality of vibrating bodies is fastened between said two lids via buffering materials.

4. The bending vibration type sound transmitter according to claim 1, wherein each of said two lids includes at least one bolt hole for arranging a stepped bolt, and said two lids are fixed by said stepped bolt arranged in said bolt hole and at least one nut fastened to said stepped bolt.

5. The bending vibration type sound transmitter according to claim 2, wherein said resonating vibrator is tabular and includes a concave portion in which said driving vibrator is arranged.

6. The bending vibration type sound transmitter according to claim 2, wherein said resonating vibrator includes a first tabular member having a concave portion and a second tabular member joining said first tabular member, said driving vibrator is arranged in said concave portion and a space is formed between said second tabular member and said driving vibrator.

7. The bending vibration type sound transmitter according to claim 1, further comprising:

a coating member for covering at least around said plurality of vibrating bodies.

8. The bending vibration type sound transmitter according to claim 7, wherein said coating member includes an insulating material.

9. The bending vibration type sound transmitter according to claim 2, further comprising:

at least one signal line which is electrically connected with said driving vibrator to which said electric signal is applied.

10. The bending vibration type sound transmitter according to claim 9, wherein at least one of said two lids includes at least one signal line hole for arranging said signal line therein.

11. The bending vibration type sound transmitter according to claim 3, wherein said buffering materials include at least onion skin paper.

* * * * *